US009560945B2

(12) United States Patent
Stein et al.

(10) Patent No.: US 9,560,945 B2
(45) Date of Patent: Feb. 7, 2017

(54) FLOOR CARE APPLIANCE

(71) Applicant: Stein & Co. GmbH, Velbert (DE)

(72) Inventors: Thomas Stein, Velbert (DE); Hartmut Boll, Velbert (DE)

(73) Assignee: Stein & Co. GmbH, Velbert (DE)

( * ) Notice: Subject to any disclaimer, the term of this patent is extended or adjusted under 35 U.S.C. 154(b) by 91 days.

(21) Appl. No.: 14/704,020

(22) Filed: May 5, 2015

(65) Prior Publication Data

US 2015/0320277 A1 Nov. 12, 2015

(30) Foreign Application Priority Data

May 6, 2014 (DE) ..... 10 2014 006 682
Jul. 5, 2014 (DE) ..... 10 2014 010 098

(51) Int. Cl.

| | |
|---|---|
| ***A47L 5/30*** | (2006.01) |
| ***A47L 9/04*** | (2006.01) |
| ***A47L 9/28*** | (2006.01) |
| ***A47L 9/30*** | (2006.01) |

(52) U.S. Cl.

CPC ..... *A47L 9/0411* (2013.01); *A47L 5/30* (2013.01); *A47L 9/0444* (2013.01); *A47L 9/0477* (2013.01); *A47L 9/2831* (2013.01); *A47L 9/2847* (2013.01); *A47L 9/2857* (2013.01); *A47L 9/2889* (2013.01); *A47L 9/30* (2013.01)

(58) Field of Classification Search

CPC .... A47L 9/0411; A47L 9/0444; A47L 9/2847; A47L 9/2889; A47L 9/2831; A47L 9/2857

See application file for complete search history.

(56) References Cited

U.S. PATENT DOCUMENTS

| | | | | |
|---|---|---|---|---|
| 5,056,175 | A | 10/1991 | Stein et al. | |
| 5,555,962 | A | 9/1996 | Hinterlechner | |
| 2008/0022486 | A1* | 1/2008 | Burlington | A47L 5/22 15/412 |

OTHER PUBLICATIONS

German Search Report, Jul. 5, 2014.

* cited by examiner

*Primary Examiner* — David Redding
(74) *Attorney, Agent, or Firm* — Greer, Burns & Crain Ltd.

(57) ABSTRACT

A floor care appliance in the form of a brush vacuum cleaner having a brush set facing the floor for receiving a driven brush roller with an overload protection. A drive disk is mounted rotatably on the shaft and the shaft has a torque-proof output element to the brush roller and the drive disk is coupled via a torsion spring to a coupling disk which is displaceable axially on the shaft and which is coupled in a torque-proof manner via cams to the shaft. Ramps are formed on the drive disk which, above a torque threshold, axially adjust the coupling disk with corresponding ramps by relative twisting. A safety shutdown can be controlled via the adjusting movement via a corresponding switching element of a circuit arrangement.

7 Claims, 5 Drawing Sheets

FLOOR CARE APPLIANCE

CROSS-REFERENCES TO RELATED APPLICATIONS

This application claims the benefit of the German patent application No. 10 2014 006 682.7 filed on May 6, 2014, and of the German patent application No. 10 2014 010 098.7 filed on Jul. 5, 2014, the entire disclosures of which are incorporated herein by way of reference.

BACKGROUND OF THE INVENTION

The invention relates to a floor care appliance in the form of a brush vacuum cleaner having a brush set facing the floor for receiving a driven brush roller with an overload protection, where the brush set can be connected by means of a pivotable connecting element in the form of a connecting piece for an attachable filter housing to a handle in the form of a hand grip via corresponding connections and where the brush set has at least one electric motor for a suction fan and for the drive of the brush roller, and the brush roller is assigned a unit for detecting torque and a safety shutdown is accomplished by means of a triggerable switching unit above a torque threshold due to overload.

It is known to configure safety devices for brush vacuum cleaners which carry out a mechanical or electronic decoupling in the event of overload and blocking of the driven brush roller. In this case it is provided either to perform an electronic shutdown by slippage of a non-positively arranged belt for driving by a built-in slip or ratchet coupling with a controller which monitors the power of the drive or to perform an electronic shutdown by means of a torque measurement and evaluation by microcontrollers with subsequent electronically triggered shutdown of the electrical drive. In particular in devices having only one motor for fan and brush drive, this can only be solved in a very complex and cost-intensive manner in order to ensure a long stability and operating safety. Documentary prior art is disclosed in U.S. Pat. No. 5,056,175 A of the applicant and in U.S. Pat. No. 5,555,962 A.

SUMMARY OF THE INVENTION

It is an object of the invention to improve a mechanical torque detection of a motor for generic vacuum cleaners in order to actuate an associated triggering mechanism and ensure a good functionality.

The solution of this object is accomplished according to the invention whereby the unit for torque detection is formed by a drive disk and is rotatably mounted on a shaft, where the shaft has a torque-proof output element for the brush roller and the drive disk is coupled via a torsion spring to a coupling disk which is displaceable axially on the shaft and which is rotatably coupled to the shaft by means of cams, wherein ramps are formed on the drive disk which above a torque threshold axially adjust the coupling disk with corresponding ramps by relative twisting and a safety shutdown can be controlled by means of the adjusting movement via a corresponding switching element of a circuit arrangement.

A compact, low-wear unit for mechanical torque detection and control of switching elements is thus provided. At the same time, a damping in particular for the belt drives of the system is performed simultaneously by the torsion spring in order to compensate for impact loads. In addition, time delays for the adjusting movement of the coupling disk are made possible in order to compensate for torque peaks.

Here it is provided that the circuit arrangement is arranged as an electrical switch, reed contact, light curtain or mechanical spring-loaded switch for shutting down the motor.

A simple solution of a circuit arrangement consists in that a triggering element which can be coupled to the coupling disk is formed by an eddy current disk arranged coaxially rotatably on the shaft, which with associated magnets transmits a force from the rotating system to a fixedly arranged switch element and triggers a switching process for the safety shutdown of the motor.

A compact embodiment is provided whereby the drive disk comprises a cup-shaped receptacle for torsion spring, coupling disk with cams and the ramps.

It is further proposed that the coupling disk has an attachment which bears front-side ramps and has an axially aligned elongate hole for receiving the cam in the form of a pin for coupling to the shaft.

In order to increase a tilt protection of the drive disk, it is provided that the drive disk is additionally mounted rotationally and axially on the attachment of the coupling disk with interposed associated bushings.

In order to improve the functional safety it is proposed that the displaceable coupling disk is assigned a return spring as counterforce to the ramp rise.

BRIEF DESCRIPTION OF THE DRAWINGS

An exemplary embodiment of the invention is shown schematically in the drawings. In the figures.

DETAILED DESCRIPTION OF THE PREFERRED EMBODIMENTS

Figure 1:
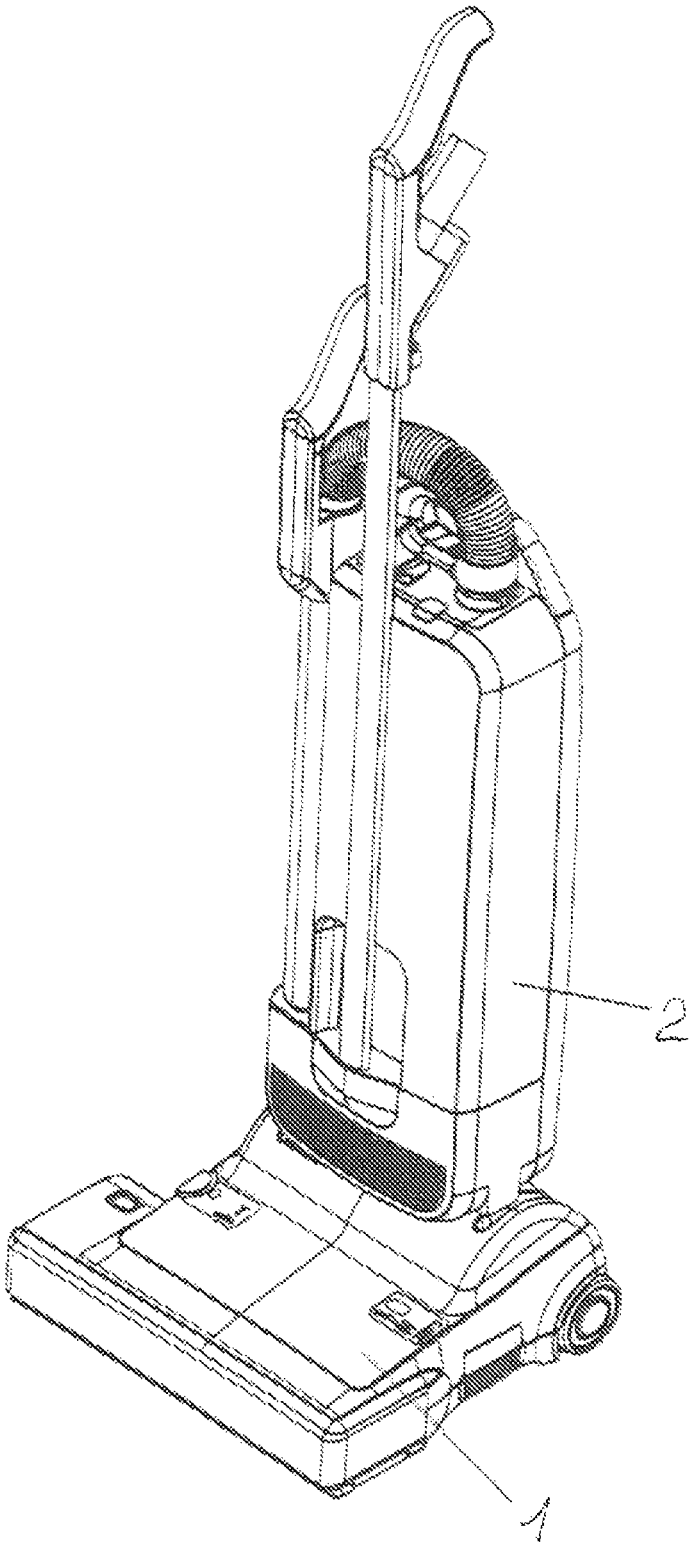
FIG. 1 shows a brush vacuum cleaner with a brush set and a filter housing placed thereon.
Figure 2:
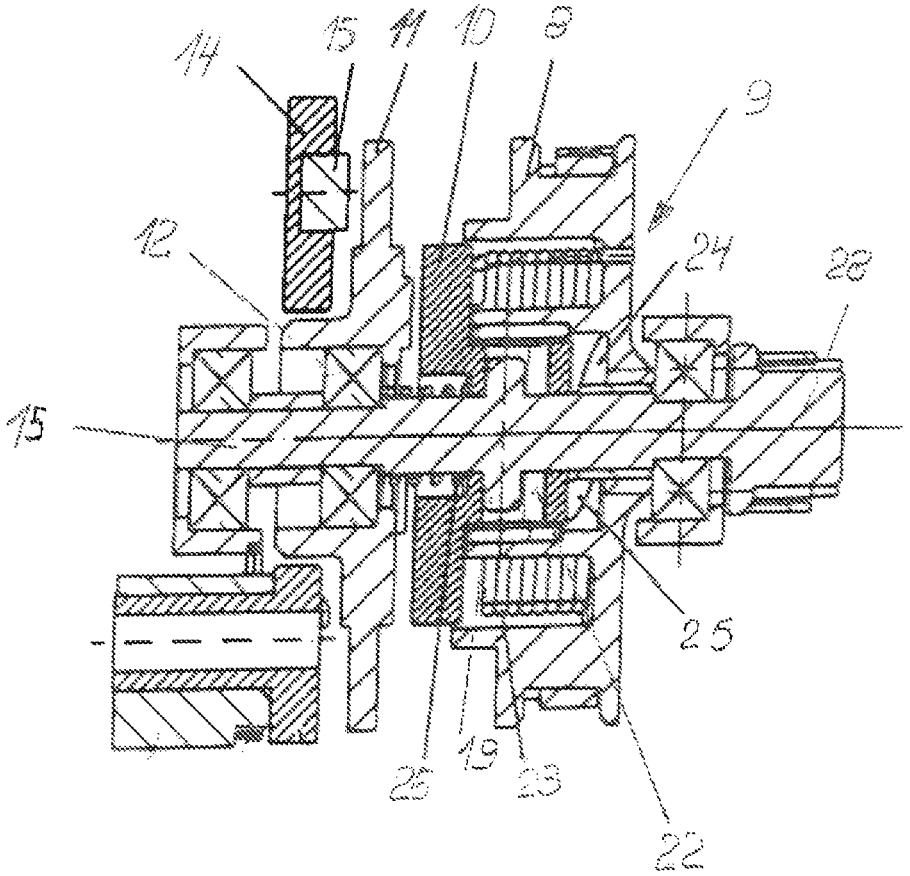
FIG. 2 shows a sectional view of a unit for torque detection with a switching device.
Figure 3:
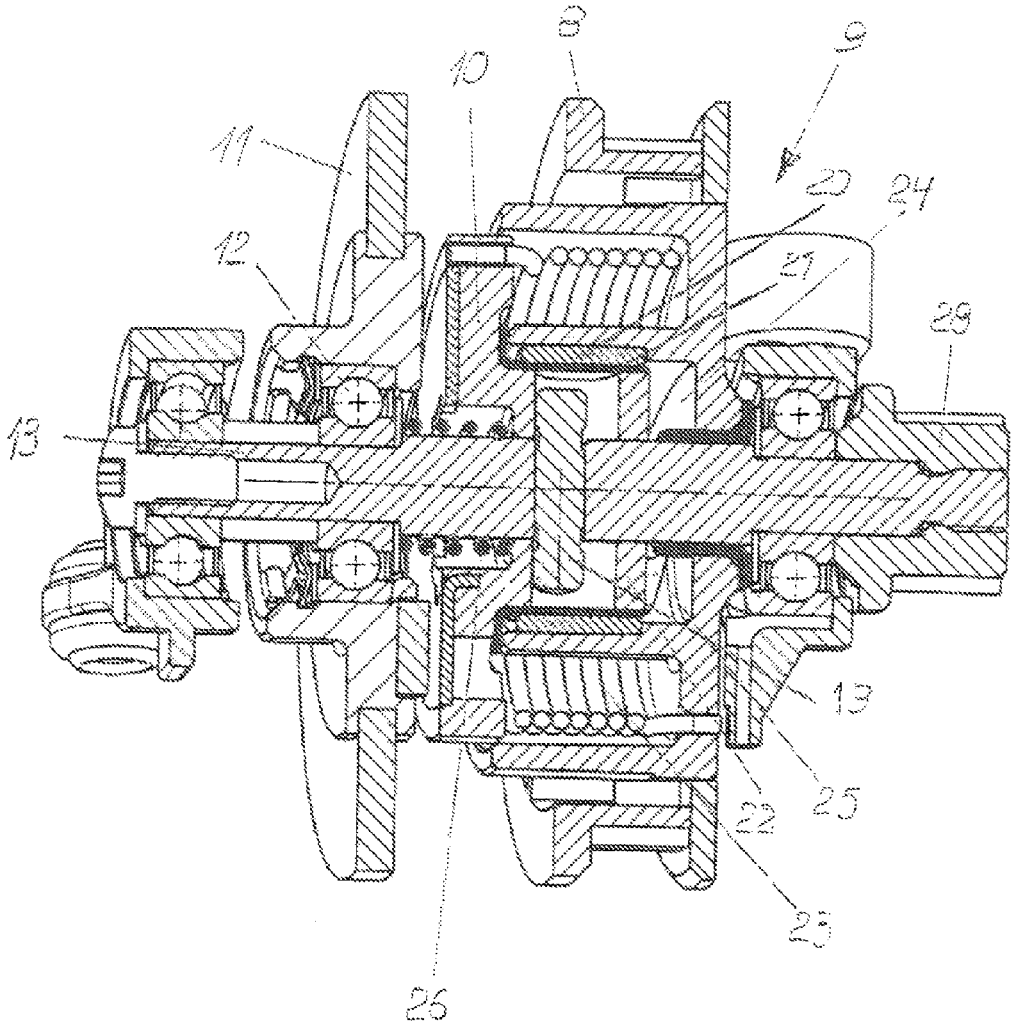
FIG. 3 shows a diagrammatic view of the unit for torque detection according to FIG. 2.
Figure 4:
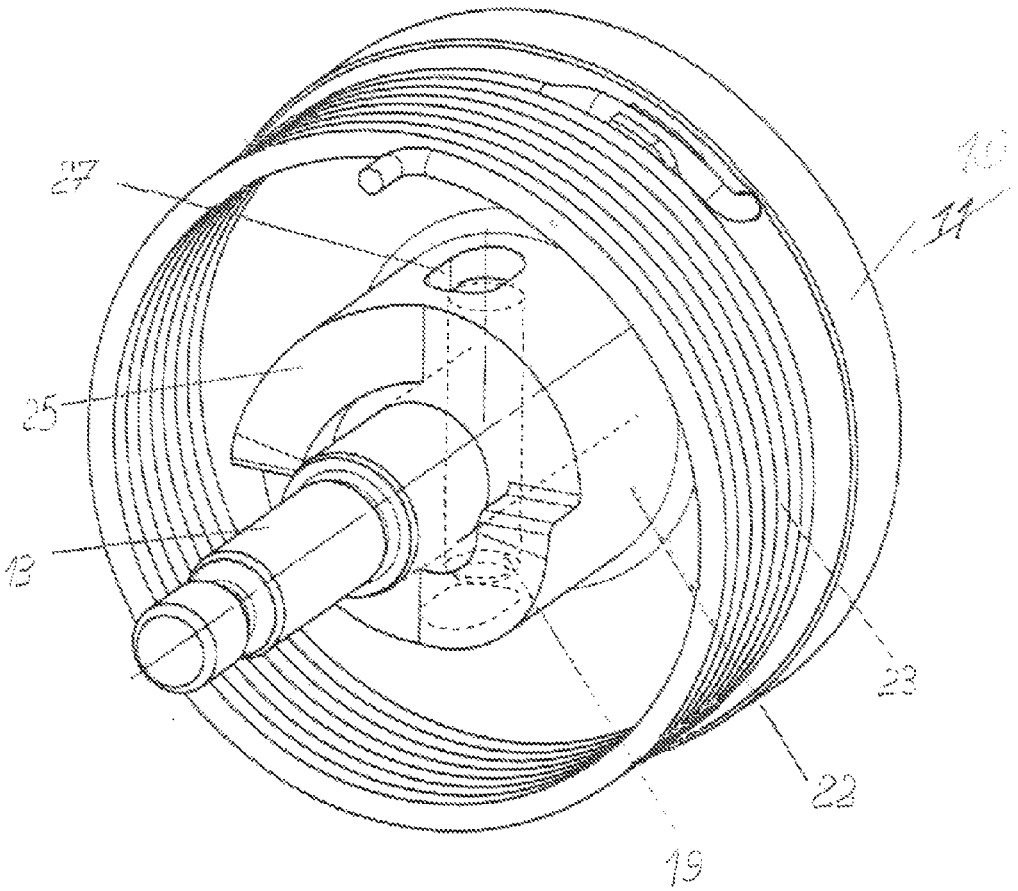
FIG. 4 shows a perspective view of a coupling disk with torsion spring on the shaft with an elongate hole in the attachment for the cams for shaft coupling.
Figure 5:
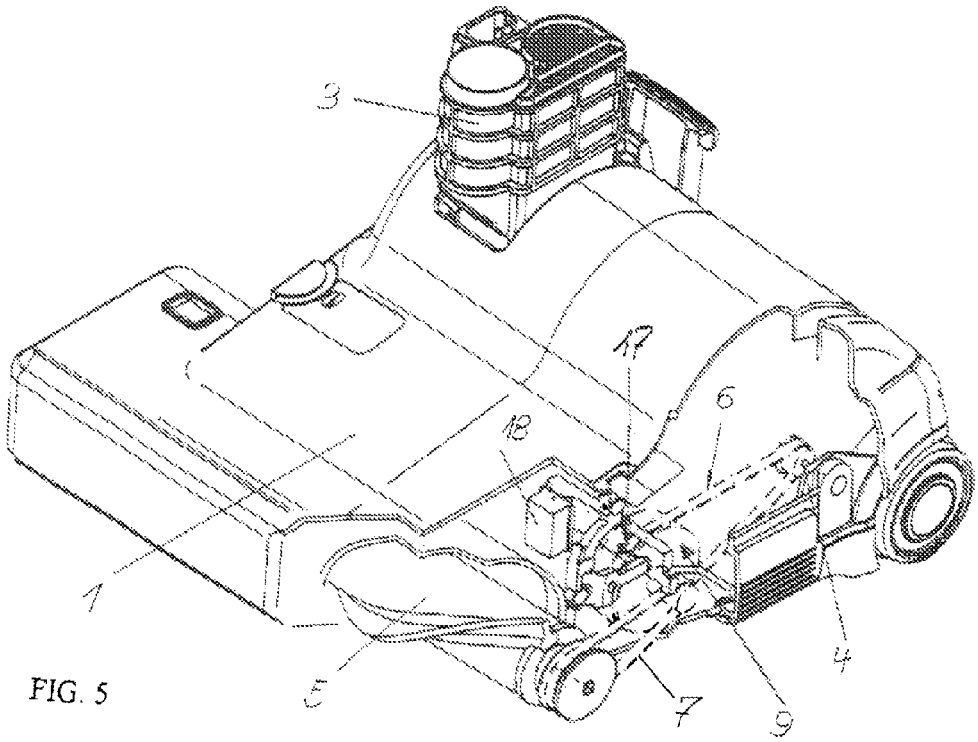
FIG. 5 shows a brush set in perspective view with a unit for torque detection and switching elements and FIG. 6 shows a side view of an eddy current disk with associated pivotable lever as switching element.
Figure 6:
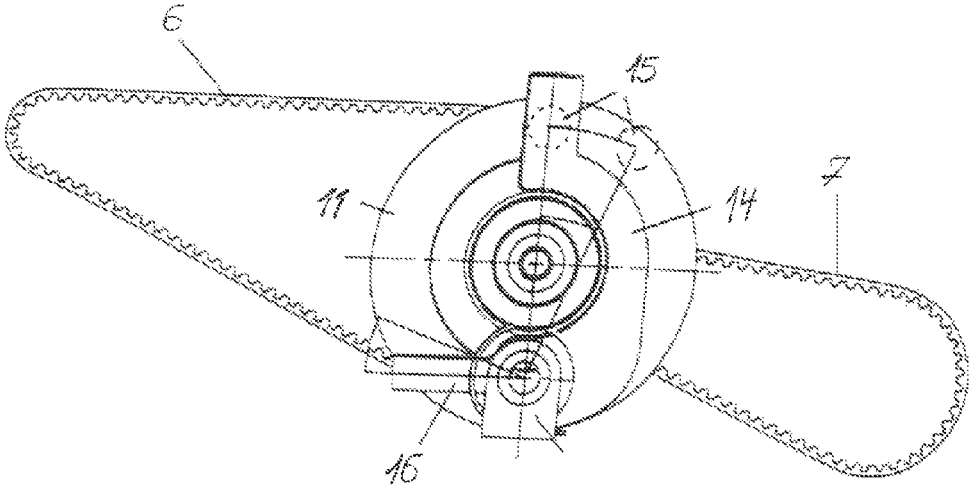

In a brush vacuum cleaner shown, a brush set 1 is connected to an attachable filter housing 2 by means of a pivotable connecting element 3 in the form of a connecting piece. The brush set 1 has an electric drive not shown in detail with a drive pinion 4 for a brush roller 5 via a drive train 6, 7 and at the same time for a suction fan likewise not shown. A slip coupling is disposed in the conventional manner in the drive train 7 for the brush roller 5.

A co-rotating drive disk 8 of a unit 9 for mechanical torque detection is located on a shaft 13 in the drive train 6, 7. In this case, in the event that a torque threshold is exceeded due to overload, an associated body of rotation in the form of eddy current disk 11 can be acted upon by a switchable or extendable coupling element 10 as disk element of the unit 9 for torque detection. The eddy current disk 11 can be coupled via a bearing 12 concentrically on the shaft 13 to the drive disk 8 and the driven coupling element 10 of the unit 9 for torque detection via a contact surface as a low-slip connection.

For executing a switching process, a movable support in the form of a fixedly mounted lever 14 is assigned parallel to the eddy current disk 11 which bears a magnet 15 in the external region to form an eddy current. In this case the rotation path of the lever 14 and the plane of rotation of the eddy current disk 11 run approximately parallel.

When the torque threshold is exceeded, the eddy current disk 11 is thus driven via the coupling element 10. In this case, a force is applied to the pivotable lever 14 by the magnetic field formed by the generated eddy current via the magnet 15 disposed on the lever 14, which lever is thus pivoted and by means of a connected triggering arm 16 via a triggering mechanism 17 actuates a switch 18 for shutting off the drive 4.

In this embodiment the unit 9 for torque detection incorporated in the drive train 6, 7 is combined with a reducing gear. The shaft 13 in this case has an output element 28 connected to it in a torque-proof manner for the brush roller 5.

In order to form the unit 9 for torque detection, the drive disk 8 is located non-displaceably twistably on the shaft 13 by means of a bearing. The associated coupling disk 10 is located displaceably on the shaft 13 and coupled to the shaft 13 by means of a cam 19. The coupling disk 10 has an attachment 22 which engages in the region of a formed receiving space of the drive disk 8 which is encased by a bushing 20 and is assigned a bushing 21 of the drive disk 8. The attachment 22 has an elongate hole 27 located in the direction of the shaft axis in which the cam 19 in the form of a pin connected to the shaft 13 engages. The drive disk 8 and the coupling disk 10 are coupled via a torsion spring 23 to form a torque detection, which is in each case fixed on the drive disk 8 and the coupling disk 10.

The connection between drive disk 8 and coupling disk 10 to drive the shaft 13 is thus accomplished via the torsion spring 23. When a torque threshold is exceeded, this results in twisting of the coupling disk 10 with respect to the drive disk 8 against the force of the torsion spring 23.

The drive disk 8 and the coupling disk 10 have associated ramps 24, 25 which displace the displaceable coupling disk 10 by twisting with respect to one another on exceeding the torque threshold outwards against the force of an associated return spring 26 and which return the coupling disk 10 into its initial position after a switching process.

As a result of the adjusting movement of the coupling disk 10 outwards, a corresponding triggering mechanism 17 with a switch 18 can be executed to shut down a driven drive pinion 4. In this case, the aforesaid shutdown is performed via a triggering arm 16 of a pivotable lever 14 by the couplable eddy current disk 11. Naturally, any other circuit can also be triggered by the adjusting movement of the coupling disk 10.

Disclosed is a floor care appliance in the form of a brush vacuum cleaner having a brush set facing the floor for receiving a driven brush roller with an overload protection, wherein a drive disk is mounted rotatably on the shaft and the shaft has a torque-proof output element to the brush roller and the drive disk is coupled via a torsion spring to a coupling disk which is displaceable axially on the shaft and which is coupled in a torque-proof manner via cams to the shaft and ramps are formed on the drive disk which above a torque threshold axially adjust the coupling disk with corresponding ramps by relative twisting and a safety shutdown can be controlled by means of the adjusting movement via a corresponding switching element of a circuit arrangement.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a brush vacuum cleaner having a brush set facing the floor for receiving a driven brush roller with an overload protection, comprising:

the brush set being connected via a pivotable connecting element in the form of a connecting piece for an attachable filter housing to a handle in the form of a hand grip via corresponding connections;

the brush set having at least one electric motor for a suction fan and for the drive of the brush roller, which includes a torque detecting unit;

a triggerable switching unit configured to initiate a safety shutdown above a torque threshold due to overload;

the torque detection unit being formed by a drive disk and being rotatably mounted on a shaft;

the shaft having a torque-proof output element to the brush roller;

the drive disk being coupled via a torsion spring to a coupling disk which is displaceable axially on the shaft and which is coupled to the shaft in a torque-proof manner via cams; and ramps being formed on the drive disk which, above a preset torque threshold, axially adjust the coupling disk with corresponding ramps by relative twisting;

wherein a safety shutdown is controlled via the adjusting movement via a corresponding switching element of a circuit arrangement.

2. The floor care appliance according to claim 1, wherein the circuit arrangement comprises a switch selected from the group consisting of an electrical switch, a reed contact, a light curtain and a mechanical spring-loaded switch.

3. The floor care appliance according to claim 1, wherein a triggering element which is coupled to the coupling disk is formed by an eddy current disk arranged coaxially rotatably on the shaft, which with associated magnets transmits a force from the rotating system to a fixedly arranged switch element and triggers a switching process for the safety shutdown of the motor.

4. The floor care appliance according to claim 1, wherein the drive disk comprises a cup-shaped receptacle for a torsion spring, a coupling disk with cams and the ramps.

5. The floor care appliance according to claim 1, wherein the coupling disk has an attachment which bears front-side ramps and has an axially aligned elongate hole for receiving the cam in the form of a pin for coupling to the shaft.

6. The floor care appliance according to claim 1, wherein the drive disk is additionally mounted rotationally and axially on the attachment of the coupling disk with interposed associated bushings.

7. The floor care appliance according to claim 1, wherein the displaceable coupling disk is provided with a return spring as a counterforce to the ramp rise.

* * * * *